US009039230B2

(12) United States Patent
Crimi et al.

(10) Patent No.: US 9,039,230 B2
(45) Date of Patent: May 26, 2015

(54) APPARATUS, SYSTEM, AND METHOD FOR TRACK LIGHTING

(75) Inventors: Steven Crimi, Masaryktown, FL (US); Chris Booth, Saint Petersburg, FL (US); David Tikkanen, Waterloo (CA)

(73) Assignee: Lunastream, Inc., St. Petersburg, FL (US)

( * ) Notice: Subject to any disclaimer, the term of this patent is extended or adjusted under 35 U.S.C. 154(b) by 350 days.

(21) Appl. No.: 13/566,876

(22) Filed: Aug. 3, 2012

(65) Prior Publication Data

US 2013/0044469 A1 Feb. 21, 2013

Related U.S. Application Data

(60) Provisional application No. 61/514,826, filed on Aug. 3, 2011.

(51) Int. Cl.

| | |
|---|---|
| ***H01R 25/14*** | (2006.01) |
| ***F21S 8/06*** | (2006.01) |
| *F21V 21/34* | (2006.01) |
| *F21Y 101/02* | (2006.01) |

(52) U.S. Cl.

CPC ..... *H01R 25/142* (2013.01); *F21S 8/066* (2013.01); *F21V 21/34* (2013.01); *F21Y 2101/02* (2013.01)

(58) Field of Classification Search

CPC ..... F21V 21/00; F21V 21/005; F21V 21/008; F21V 21/02; F21V 21/025; F21V 21/08; F21V 21/34; F21V 21/03; F21V 23/001; F21V 23/06; H01R 25/16; H01R 25/161; H01R 25/162; H01R 25/14; H01R 25/142; F21S 8/04; F21S 8/043; F21S 8/046; F21S 8/06; F21S 8/066; F21Y 2103/00; F21Y 2103/025

USPC ..... 362/147, 404, 391, 647, 648; 439/507, 439/952

See application file for complete search history.

(56) References Cited

U.S. PATENT DOCUMENTS

| | | | |
|---|---|---|---|
| 3,496,518 | A | 2/1970 | Neumann et al. |
| 3,613,045 | A | 10/1971 | Routh et al. |
| 3,727,063 | A | 4/1973 | Turner |
| 3,832,503 | A | 8/1974 | Crane |
| 4,181,388 | A | 1/1980 | Donato |
| 4,688,869 | A | 8/1987 | Kelly |
| 4,776,809 | A | 10/1988 | Hall |
| 4,822,292 | A | 4/1989 | Thayer et al. |
| 5,922,981 | A | 7/1999 | Ballister |

(Continued)

FOREIGN PATENT DOCUMENTS

| | | | |
|---|---|---|---|
| CA | 2564659 | A1 | 5/2007 |
| CA | 2734757 | A1 | 3/2010 |

(Continued)

*Primary Examiner* — Thomas M Sember
(74) *Attorney, Agent, or Firm* — Kunzler Law Group

(57) ABSTRACT

A track lighting apparatus includes a frame, a power distributor, and an electrical interface. The frame includes a track configured to support a plurality of light fixtures. The power distributor electrically connects two or more inputs to two or more supply channels. Each supply channel is electrically insulated from other supply channels. The electrical interface includes electrical components that form two or more supply channels such that the supply channels form an incomplete series circuit that includes two or more breaks. A light fixture or a jumper is electrically connected across each break to complete the series circuits.

18 Claims, 9 Drawing Sheets

(56) References Cited

U.S. PATENT DOCUMENTS

| | | | | |
|---|---|---|---|---|
| 6,029,122 | A | 2/2000 | Hunt | |
| 6,351,079 | B1 | 2/2002 | Willis | |
| 6,394,626 | B1 | 5/2002 | McColloch | |
| 6,716,042 | B2 | 4/2004 | Lin | |
| 6,743,164 | B2 | 6/2004 | Airaudi et al. | |
| 7,246,935 | B2 * | 7/2007 | Benghozi et al. | 362/648 |
| 7,459,623 | B2 | 12/2008 | Robertson | |
| 7,495,671 | B2 | 2/2009 | Chemel et al. | |
| 7,501,571 | B2 | 3/2009 | Forsman et al. | |
| 7,520,762 | B2 | 4/2009 | Lehman et al. | |
| 7,550,935 | B2 | 6/2009 | Lys et al. | |
| 7,604,378 | B2 | 10/2009 | Wolf et al. | |
| 7,633,406 | B2 | 12/2009 | Miki | |
| D662,880 | S | 7/2012 | Scott et al. | |
| 8,299,987 | B2 | 10/2012 | Neudorf et al. | |
| 2003/0021111 | A1 | 1/2003 | Miller et al. | |
| 2005/0169015 | A1 | 8/2005 | Luk et al. | |
| 2006/0044841 | A1 | 3/2006 | Harwood | |
| 2007/0263386 | A1 | 11/2007 | Hockel et al. | |
| 2007/0285949 | A1 | 12/2007 | Lodhie et al. | |
| 2008/0127808 | A1 | 6/2008 | Shaffer | |
| 2008/0316730 | A1 | 12/2008 | Diederiks et al. | |
| 2009/0141493 | A1 * | 6/2009 | Stoyan | 362/249.02 |
| 2009/0312987 | A1 | 12/2009 | Uedaira et al. | |
| 2011/0204820 | A1 | 8/2011 | Tikkanen et al. | |

FOREIGN PATENT DOCUMENTS

| | | | |
|---|---|---|---|
| CA | 127922 | | 4/2010 |
| CA | 129957 | | 4/2010 |
| CA | 2767457 | A1 | 3/2011 |
| GB | 2475634 | | 3/2010 |
| WO | 2010031169 | A1 | 3/2010 |
| WO | 2011029194 | A1 | 3/2011 |

* cited by examiner

APPARATUS, SYSTEM, AND METHOD FOR TRACK LIGHTING

CROSS-REFERENCES TO RELATED APPLICATIONS

This application claims the benefit of U.S. Provisional Patent Application No. 61/514,826 entitled "Apparatus, System, and Method for Track Lighting" and filed on Aug. 3, 2011, for Steven Crimi, et al., which is incorporated herein by reference for all that it contains.

FIELD OF THE INVENTION

This invention relates to track lighting and more particularly relates to low voltage and/or multichannel track lighting for LED fixtures.

BACKGROUND

Track lighting is often used to provide lighting that can be easily manipulated or adjusted to cast light in a desired direction. Track lighting often includes a frame and/or rail that form a track along which one or more light fixtures may be mounted. Often, light fixtures may be selectively moved and or oriented to point in a desired direction by hand or with very little need for tools.

Generally, track lighting allows for the light fixtures on a track to be connected in parallel on a single channel. Because the light fixtures are electrically connected onto a single channel, any electrical changes from a power source will be reflected in all of the light fixtures. Thus, each light fixture mounted to track lighting cannot be controlled independently. For example, either all of the light fixtures on the track lighting are turned on or turned off. Generally, there is no ability to control one or more of the light fixtures independently of one or more of the other light fixtures mounted on the track.

Additionally, in the case of typical LED track lighting systems, parallel connection of light fixtures is often achieved by a power source providing a track with a constant DC voltage. Each LED fixture typically comprises an embedded power conversion circuit to convert the input constant voltage DC into a constant current output to drive the LEDs. The disadvantage of such an approach is that additional heatsinking is necessary to properly thermal manage the heat generated by the power conversion circuit which results in added weight to the LED fixture.

AC voltage track lighting systems also generally use parallel connections for connected light fixtures. Typically, the amount of power and corresponding current that can be supplied to the track lighting system is limited by a circuit breaker such as a 20 amp circuit breaker. It is possible to connect several light fixtures in parallel such that excessive heating of the track lighting system may occur before the circuit breaker would activate.

SUMMARY

From the foregoing discussion, it should be apparent that a need exists for an apparatus, system, and method that allows for light fixtures to be connected in series on multiple channels. Beneficially, such an apparatus, system, and method would provide the ability to control one or more of the light fixtures independently of one or more of the other light fixtures mounted on the track.

The present invention has been developed in response to the present state of the art, and in particular, in response to the problems and needs in the art that have not yet been fully solved by currently available track lighting systems. Accordingly, the present invention has been developed to provide an apparatus, system, and method for track lighting that overcome many or all of the above-discussed shortcomings in the art.

The track light apparatus, in one embodiment, includes a frame. The frame, in one embodiment, includes a track that is configured to support a plurality of light fixtures. In one embodiment, the apparatus further includes a power distributor that electrically connects two or more inputs to two or more supply channels. The supply channels, in a further embodiment, are electrically insulated from other supply channels. The apparatus, in one embodiment, further includes an electrical interface that has electrical components forming two or more supply channels. The two or more supply channels, in one embodiment, form an incomplete series circuit that includes two or more breaks. In a further embodiment, a light fixture or a jumper is electrically connected across each break, completing the series circuits and forming series circuits that include two or more light fixtures.

In one embodiment, the frame is an elongated shape that supports a plurality of light fixtures along the length of the frame on a track. In a further embodiment, the frame includes an elongated recess wherein the electrical interface is placed. The frame, in one embodiment, includes a cover for concealing all or a portion of the electrical interface within the elongated recess. The frame also includes, in one embodiment, a C-shaped cross-section or an I-shaped cross-section.

The power distributor, in one embodiment, includes an input connector for receiving electrical input from a power source. In a further embodiment, the power distributor includes a printed circuit board that includes a plurality of traces.

The electrical interface, in one embodiment, includes two or more printed circuit boards that are connected in series to form an incomplete series circuit for each supply channel. The supply channels, in one embodiment, include a contact surface on each side of the breaks. The breaks, in a further embodiment, may be factory created breaks or technician created breaks. In one embodiment, the apparatus further includes a cover for selectively barring or covering all or a portion of the electrical interface.

The light fixture of the apparatus, in one embodiment, includes a housing for supporting one or more lamps. In one embodiment the one or more lamps include one or more light emitting diodes.

A method is also presented. The method in the disclosed embodiments substantially includes the steps necessary to carry out the functions presented above with respect to the operation of the described apparatus and system. In one embodiment, the method includes providing a track light apparatus and mounting two or more light fixtures to the frame of the apparatus. The method also may include electrically connecting a light fixture and a jumper across each of the breaks to form a series circuit that includes two or more light fixtures on at least one of the supply channels. In a further embodiment, the method may include applying electrical power to each supply channel, such that the light fixtures are energized to emit light. In one embodiment, the electrical power applied to each supply channel includes a low voltage.

In one embodiment, the frame is an elongated shape that supports a plurality of light fixtures along the length of the frame on a track. In a further embodiment, the frame includes an elongated recess wherein the electrical interface is placed.

The frame, in one embodiment, includes a cover for concealing all or a portion of the electrical interface within the elongated recess.

A system of the present invention is also presented. In particular, the system, in one embodiment, includes a power supply that supplies electrical power to two or more inputs. In a further embodiment, the system provides a track light apparatus and a plurality of light fixtures, such that one of the light fixtures and a jumper are electrically connected across each break to form series circuits that include two or more light fixtures.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
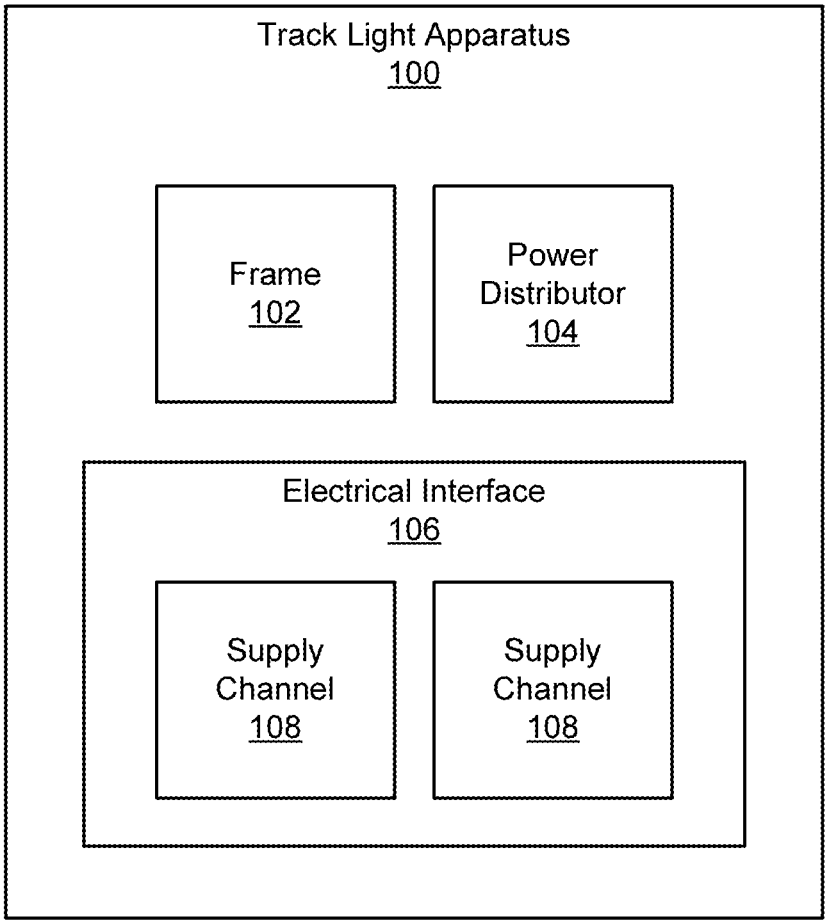
FIG. 1 is a schematic block diagram illustrating one embodiment of a track light apparatus in accordance with the present invention.

FIG. 1 depicts a schematic block diagram of one embodiment of a track light apparatus 100. In one embodiment, a track light apparatus 100 includes a frame 102, a power distributor 104, and an electrical interface 106. In one embodiment the electrical interface 106 includes one or more supply channels 108.

In one embodiment, the track light apparatus 100 provides a frame and track for mounting one or more light fixtures. In one embodiment, the track light apparatus 100 receives power from a power source to power one or more light fixtures. In one embodiment, the power source is mounted remotely from the track light apparatus 100. Further discussion regarding exemplary power sources for providing power to a track light apparatus 100 is provided in relation to FIG. 6.

In one embodiment, the frame 102 provides a structure for mounting other components of the track light apparatus 100. In one embodiment, the frame 102 provides a structure for mounting one or more light fixtures or other electrical components. In one embodiment, the frame 102 comprises a track that is configured to support one or more light fixtures. As used herein the term light fixture is given to mean any apparatus, device, or structure that includes a light source.

In one embodiment, a light fixture may be positioned at substantially any position along the length of the track. In one embodiment, a track includes one or more structural features along which a light fixture may be attached. In one embodiment, the track may include rails which allow for attachment substantially anywhere along a length of the track. For example, a light fixture may be inserted and/or slid along the track to a desired location. According to one embodiment, two or more light fixtures may be mounted on the track at the same time so that the frame 102 supports two or more light fixtures.

The frame 102 may also include features for mounting the track to a structure, such as a ceiling or wall of a building. In one embodiment, the frame includes one or more holes for receiving a fastener. For example, a fastener may be used to attach the track light apparatus 100 to a wall or ceiling within a building. For example, a screw, nail, bolt, or other fastener may be used. According to one embodiment, one or more arms, brackets, or other mounting features may be used. For example, arms extending from the frame 102 may be attached to a wall or ceiling of a structure or building. In another example, one or more brackets may be mounted to a wall or ceiling or any other portion of a structure or building and the frame 102 may be mounted to the one or more brackets.

In one embodiment, the frame 102 includes one or more structural features for receiving, mounting, or retaining other components of the track light apparatus 100 on or within the frame 102. In one embodiment, the frame 102 includes a cavity within which at least a portion of the power distributor 104 and/or electrical interface 106 may be placed. According to one embodiment, the frame 102 may include one or more protrusions for securely retaining one or more components within a cavity. According to one embodiment, the track light apparatus 100 may include an input for receiving electrical power. According to one embodiment, the track light apparatus 100 includes a hole through which a cable may be inserted to provide electrical power to the track light apparatus 100.

The frame 102 may be formed of one or more of a plurality of materials. For example, the frame 102 may be formed of a plastic, metal, wood, or any other material. The frame 102 may be painted or may comprise materials having one or more different colors. According to one embodiment, the frame 102 may have virtually any shape. In one embodiment, the frame 102 has an elongated shape. In varying embodiments, the frame 102 may be straight, curved, wavy or any other shape. The shape and size of the frame 102 may vary considerably. According to one embodiment, the frame 102 may largely define an overall appearance of the track light apparatus 100. In one embodiment, the frame 102 may be aesthetical pleasing as it may provide the overall shape of a track lighting system.

In light of the present disclosure one of skill in the art will recognize numerous possible variations on the shape, size, and material of the frame 102 in addition to those discussed herein.

In one embodiment, the track light apparatus 100 includes a power distributor 104. In one embodiment, the power distributor 102 electrically connects one or more inputs, such as an output from a power supply, with one or more supply channels, such as supply channels 108 of the electrical interface 106. In one embodiment, the power distributor 104 electrically connects two or more inputs with two or more supply channels. In one embodiment, if the track light apparatus 100 includes more than one supply channel, each of the supply channels may be insulated from each other. For example, the power distributor 104 may maintain electrical input from two or more inputs electrically insulated from each other.

According to one embodiment, an electrical input to the track light apparatus 100 may be connected to the power distributor 104. For example, if the power distributor resides within the frame 102 an electrical input may be inserted into the frame and electrically connected to the power distributor. According to one embodiment, the power distributor 104 may include one or more male, female, or hermaphroditic electrical connectors for connecting to an electrical input. For example, an electrical input, such as a power source or a cable from a power source may be connected to the power distributor 104 using one or more connectors that correspond to the connector(s) of the power distributor 104.

According to one embodiment, the power distributor 104 may include one or more electrical components to electrically connect an input with the electrical interface 106 and/or one or more supply channels 108 of the electrical interface 106. According to one embodiment, the power distributor may include one or more wires for routing power from a specific input to a specific supply channel. For example, the power distributor 104 may include one or more insulated wires and/or one or more connectors for providing an electrical connection between an electrical input (for example from an output of a power source) and a supply channel 108. According to one embodiment, the power distributor 104 may include a printed circuit board with linear traces for routing power from one or more input connectors to one or more electrical supply channels 108. In one embodiment, the power distributor 104 may include a printed circuit board and one or more connectors for coupling power to one or more supply channels 108. In one embodiment, the power distributor 104 may include an input connector which receives power from one or more inputs from one or more power sources.

In light of the present disclosure one of skill in the art will recognize numerous possible variations on the power distributor 104 in addition to those discussed herein.

In one embodiment, the track light apparatus 100 includes an electrical interface 104. In one embodiment, the electrical interface 106 includes electrical components forming one or more supply channels 108. In one embodiment, the electrical interface 106 includes electrical components forming two or more supply channels, such as the supply channels 108 of FIG. 1.

In one embodiment, the electrical interface 106 may include one or more conductors, insulators, contact surfaces, connectors, or other electrical components. In one embodiment, each supply channel 108 forms an incomplete series circuit. In one embodiment, each incomplete series circuit includes one or more breaks. In one embodiment, each incomplete series circuit includes two or more breaks. In one embodiment, each break includes a portion of the supply channel 108 across which current may not flow. For example, there may be a break in a conductor or between two or more conductors across which current cannot flow. For example, a voltage and/or current provided by a power source may not be sufficient to cause current to flow across the break.

In one embodiment, in order for the series circuit of each channel to be completed one or more components must be connected across each break. For example, in one embodiment, a light fixture or jumper connected across each break may complete a series circuit of a supply channel 108. In one embodiment, each supply channel 108 may include a contact surface on each side of a break. For example, a conductive surface on either side of a break of a supply channel 108 may be included which allows electrical contact to be formed with conductors on each side of the break. For example, a connector including protrusions may be mounted on the track light apparatus 100 to create contact across the break. In one embodiment, a jumper or light fixture may be electrically connected to the connector to allow current to flow through the jumper or light fixture and across a break.

In one embodiment, each break may include a connector or socket to which a jumper or light fixture may be connected. For example, a male, female, or hermaphroditic connector may be placed at the location of each break. In one embodiment, a jumper or light fixture may include a connector corresponding to a connector at a break which may be used to form an electrical connection across the break.

According to one embodiment, with a jumper or light fixture connected across each break a series circuit is formed through which a current may flow. Thus, an output from a power source may be used as an electrical input to the track light apparatus 100 to provide power to each supply channel 108.

The electrical interface 106 may be formed in a variety of manners. In one embodiment, the electrical interface 106 may include one or more printed circuit boards. In one embodiment, two or more circuit boards may be connected to form an incomplete series circuit for each supply channel 108. According to one embodiment, conductive traces on a printed circuit board may form modular portions of the electrical interface 106. For example, two or more substantially identical circuit boards may be selectively connected to form at least a portion of the electrical interface 106.

In one embodiment, the electrical interface 106 may include a non-conductive substrate with one or more elongated conductors mounted on the substrate. In one embodiment, the elongated conductors may act as contacts along which light fixtures may be electrically connected. According to one embodiment, the substrate may extend substantially a length of the frame 102 of the track light apparatus 102. According to one embodiment, each of the elongate conductors may be interconnected using one or more connectors, jumpers, and/or light fixtures. See FIG. 9A and the corresponding discussion for further detail.

In one embodiment, breaks in each supply channel 108 may be created during manufacture or may be created by an end user or installing technician. For example, breaks may be created during manufacture across which a jumper or light fixture may be connected during installation. In one embodiment, a technician may be able to remove a portion of a conductor or cut a conductor to create a break where a light fixtures or jumper may be installed.

In light of the present disclosure one of skill in the art will recognize numerous additional components, and methods of forming the electrical interface 106 and one or more supply channels 108.

In one embodiment, the track light apparatus 100 allows two or more light sources to be connected in series on a single supply channel 108. In one embodiment, placing two or more light fixtures on a single supply channel 108 provides for safer operation. For example, as each new light fixture is added to a supply channel 108 the overall impedance of the circuit is increased. If the light fixtures were placed in parallel, each new fixture would reduce overall impedance.

In one embodiment, the track light apparatus 100 also allows for a single track light apparatus to include more than one supply channel 108. This may allow for independent control of light fixtures or groups of light fixtures. For example, one or more light fixtures on one channel may be turned on, dimmed, or controlled independently of light fixtures on a second channel.

The separate channels of the light fixture may allow for a simpler or less sophisticated light fixture or track light apparatus. For example, control of the supply channels 108, and thus any light fixtures on the supply channels, may be done by a power supply or control system independent of the track light apparatus 100. Thus, the track light apparatus 100 may or may not include a micro controller or other control circuitry even if sophisticated control of the attached light fixtures is desired. In one embodiment, the lack of need for control circuitry within the track light apparatus 100 may reduce the cost of the apparatus as well as a complete lighting control system.

According to one embodiment, a track light apparatus 100 may have a low voltage class rating for low voltage light fixture and/or light sources. According to one embodiment, the track light apparatus 100 has a class 2 voltage rating. This may allow the track lighting to meet safety standards for that class.

Figure 2A:
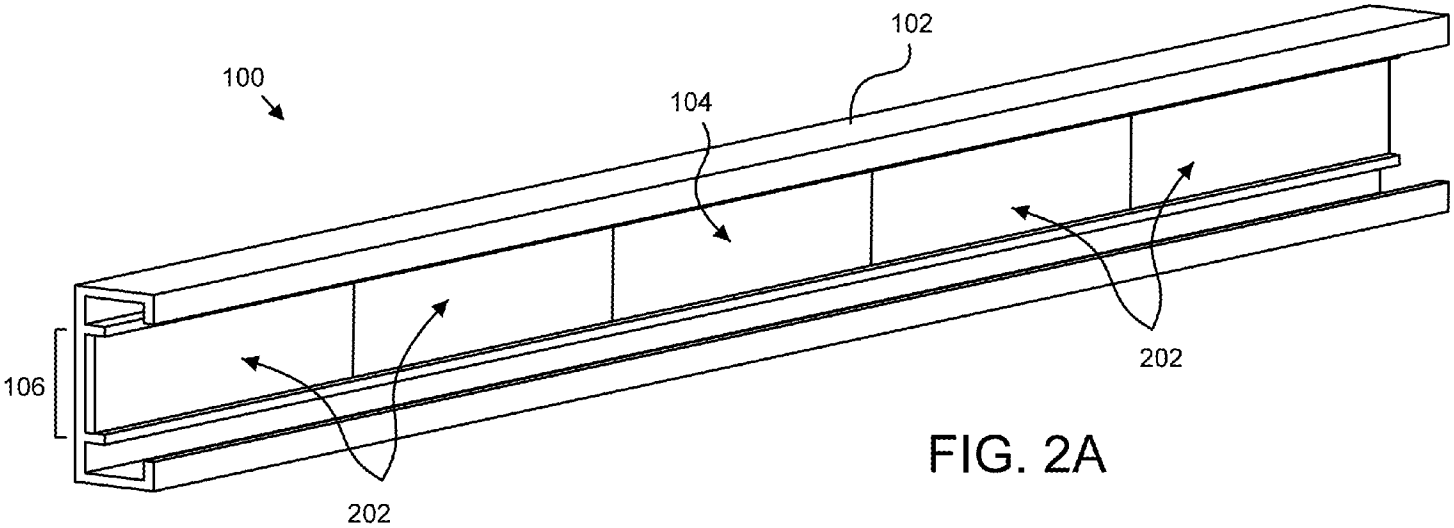
FIG. 2A is a perspective view illustrating one embodiment of a track light apparatus in accordance with the present invention.
Figure 2B:
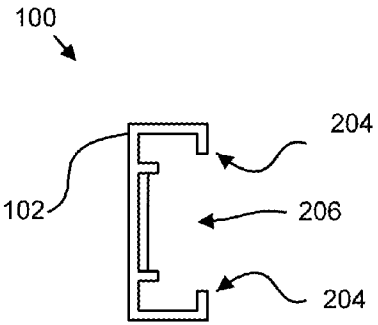
FIG. 2B is a cross-sectional side view illustrating one embodiment of a track light apparatus in accordance with the present invention.

Turning now to FIGS. 2A and 2B one exemplary embodiment of a track light apparatus 100 is shown. Specifically, FIG. 2A is a perspective view of one exemplary embodiment of a track light apparatus 100. FIG. 2B is a cross-sectional side view illustrating the cross-sectional shape of the track light apparatus 100. In one embodiment, the track light apparatus 100 includes a frame 102, a power distributor 104, and an electrical interface 106. In the embodiment depicted in FIG. 2A the electrical interface 106 includes a plurality of printed circuit boards 202 and the power distributor 104.

In one embodiment, the frame 102 includes an elongated shape having 'C' shaped cross-section. In one embodiment, the opening of the 'C' forms an elongated recess 206. In one embodiment, the electrical interface 106 and power distributor 104 are mounted within the elongated recess 206. According to one embodiment, flanges 204 and the frame 102 form a track along which light fixtures may be mounted.

The electrical interface 106 is depicted mounted within the elongated recess 206 of the frame 102. In one embodiment, the mounting of electrical components within the frame 102 may allow for reduced likelihood of electric short or wear of the internal components. Additionally, the mounting of the electrical components, such as the electrical interface 106 and power distributor 104 may allow for a clearer and more aesthetic appearance for the track light apparatus 100.

In one embodiment, the electrical interface 106 runs substantially the length of the frame 102. In one embodiment, the electrical interface 106 may include one or more wires which may be positioned according to a desired location of a light fixture. In one embodiment, this may allow one or more light fixtures to connect to an electrical interface 106 that does not run substantially the length of the frame 102. In one embodiment, the electrical interface 106 includes a number of printed circuit boards that may be interconnected to form the electrical interface 106 and the one or more supply channels 0 108. Further description of the printed circuit boards 202 will be discussed in relation to FIGS. 4 and 5.

Figure 3:
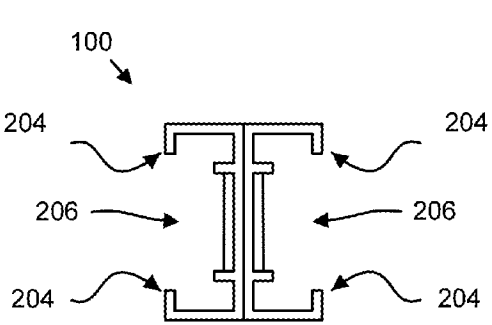
FIG. 3 is a cross-sectional side view illustrating one embodiment of a track light apparatus in accordance with the present invention.

FIG. 3 illustrates a cross sectional view of a track light apparatus 100 having an 'I' shaped cross-section, according to one embodiment. According to one embodiment, the 'I' shaped cross-section may be formed by attaching two 'C' shaped frames together. According to another embodiment, the 'I' shaped cross-section may allow the number of supply channels of a track light apparatus 100 to be doubled. For example, if the track light apparatus 100 of FIGS. 2A and 2B allows for two supply channels, the track light apparatus 100 of FIG. 3 may allow for four supply channels on a single track light apparatus 100.

Figure 4:
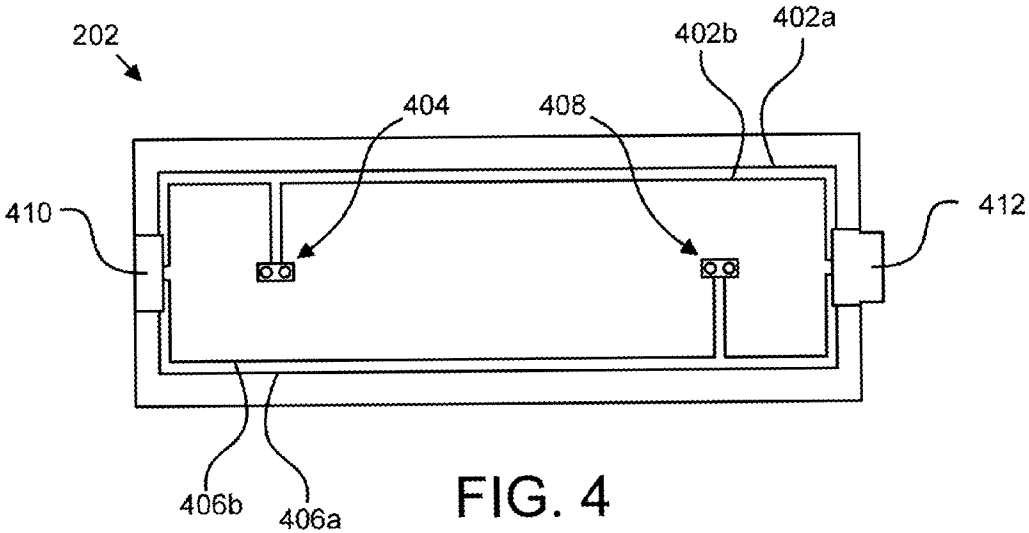
FIG. 4 is front view of one embodiment of a printed circuit board in accordance with the present invention.

FIG. 4 illustrates one embodiment of a printed circuit board 202 for forming an electrical interface 106 having two supply channels. Although other embodiments may include more or fewer traces for forming electrical interfaces having one supply channel or three or more supply channels, the present discussion is limited to two supply channels for simplicity. One of skill in the art will recognize in light of the present disclosure designs for circuit boards for fewer or more supply channels.

In one embodiment, the printed circuit board 202 includes first channel traces 402*a*, 402*b*, a first channel connector 404, second channel traces 406*a*, 406*b*, a second channel connector 408, and end connectors 410, 412. In one embodiment, the first channel traces 402*a* and 402*b* form at least a portion of a first supply channel. In one embodiment, trace 402*a* runs from one end of the printed circuit board 202 to the other end without breaks. In other words, trace 402*a* may be continuous. Trace 402*b* is depicted having a break at the location of the first channel connector 404. In one embodiment, a jumper or light fixture may be connected to the first supply channel by the first channel connector 404.

Similarly, in one embodiment, the second channel traces 406*a* and 406*b* form a portion of a second supply channel. In one embodiment, trace 406*a* runs from one end of the printed circuit board 202 to the other end without breaks. In other words, trace 406*a* may be continuous. Trace 406*b* is depicted having a break at the location of the second channel connector 408. In one embodiment, a jumper or light fixture may be connected to the second supply channel by the second channel connector 408.

According to one embodiment, the traces 402*a*, 402, 406*a*, and 406*b* run between the end connectors 410 and 412. According to one embodiment, the printed circuit board 202 may be connected using the end connectors 410 and 412 to one or more additional printed circuit boards. For example, end connector 410 may include a female connector while end connector 412 may include a male connector. Thus, two or more printed circuit boards 202 may be connected together as needed to accommodate additional light fixtures, and/or increase a length of the electrical interface 106.

Figure 5:
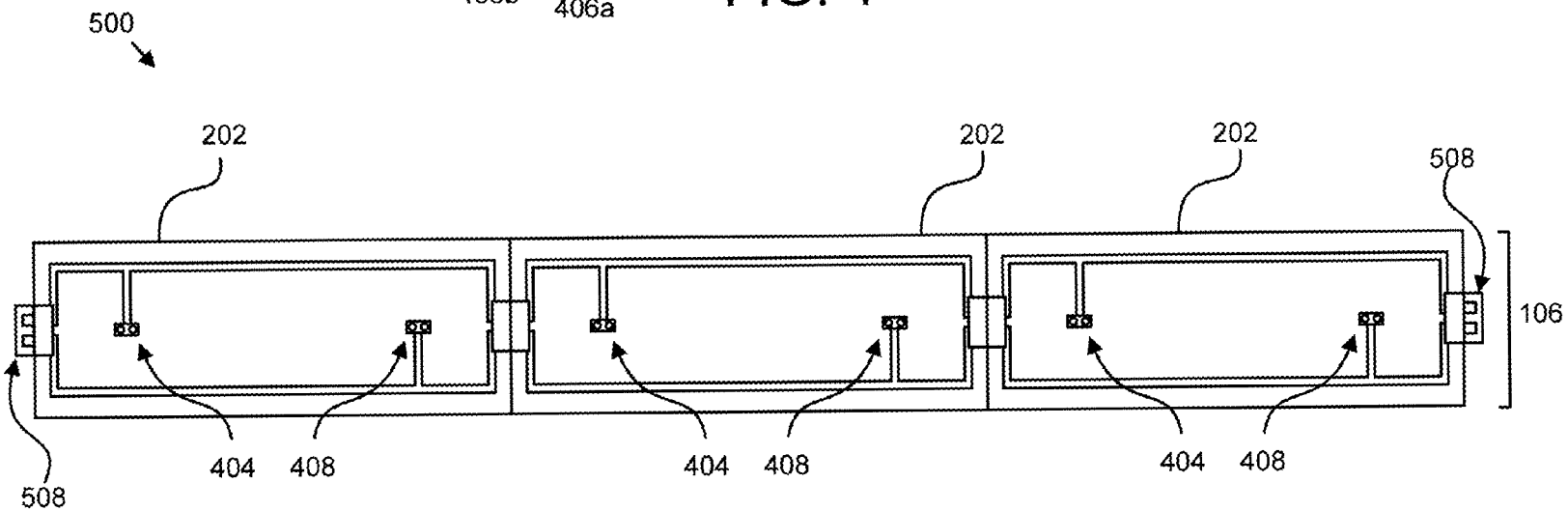
FIG. 5 is front view illustrating a plurality of connected printed circuit boards forming on embodiment of an electrical interface in accordance with the present invention.

FIG. 5 illustrates a plurality of printed circuit boards 202 connected to form on embodiment of an electrical interface 606. According to the depicted embodiment, three printed circuit boards 202 are depicted as being connected together for simplicity. As will be apparent to one skilled in the art, less than three or more than three printed circuit boards 202 may be connected without departing from the scope and content of the present disclosure.

In the depicted embodiment, the three circuit boards 202 are shown connected via the end connectors 410 and 412 of respective boards. In one embodiment, the connection between boards creates an electrical connection between respective traces. For example, trace 402*a* of one board may be electrically connected to a corresponding trace 402*a* of one or more connected boards. In the depicted embodiment, terminating connectors 508 are attached at free ends of the electrical interface 106 to connect trace 402*a* and 402*b* and 406*a* and 406*b*. The terminating connectors 508 may help complete a supply channel of the electrical interface 106.

According to one embodiment, connectors 404 and 408 of each of the printed circuit boards 202 may be connected to one of a power supply, a jumper, and a light fixture. According to one embodiment, one of the printed circuit boards 202 acts as a power distributor 104 for receiving power from an input and distributing the power to a respective channel. This will be shown and discussed in greater detail in relation to FIG. 6. According to one embodiment, the electrical interface 106 of FIG. 5 may be placed within a recess of a frame 102, such as frame 102 of FIG. 2A, 2B, or 3.

Figure 6:
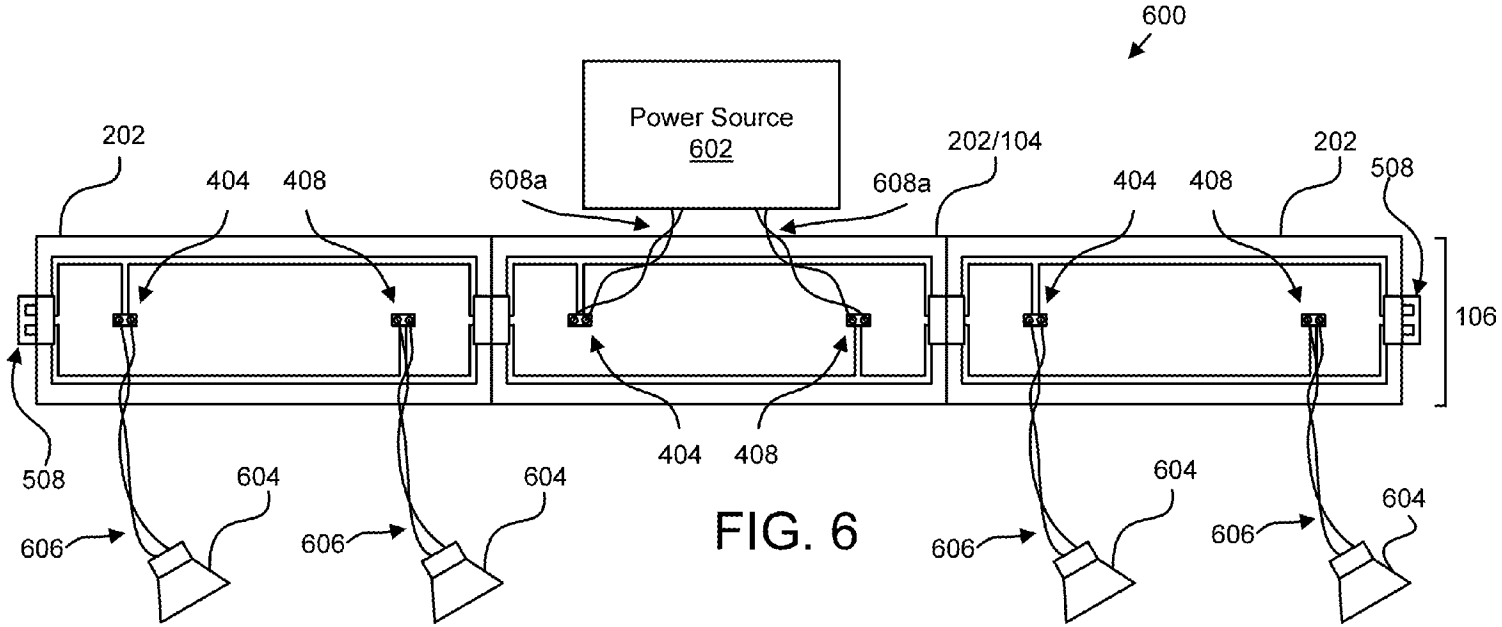
FIG. 6 is a wiring diagram of one embodiment of a track light system in accordance with the present invention.

FIG. 6 illustrates a wiring diagram of a track lighting system 600 according to one embodiment. The depicted track lighting system 600 includes a power source 602, the electrical interface 106 of FIG. 5, and a number of light fixtures 604. The frame 102 has been omitted for simplicity. According to one embodiment, the middle circuit board 202/104 of the electrical interface 106 may function as a power distributor 104. According to another embodiment, any of the circuit boards 202 may act as a power distributor 104. For example, it may be more convenient to connect a power source 602 to a printed circuit board 202 near the end of an electrical interface 106.

In the depicted embodiment, the power source 602 and light fixtures 604 are connected to the electrical interface 106 and/or power distributor 104 via a plurality of wired connections 606 and 608*a-b*. According to one embodiment, the light fixtures 604 are connected via wired connections 606 to the first and second channel connectors 404, 408 of respective printed circuit boards 202 to complete the series circuits of each channel.

According to one embodiment two of the light sources 604 are connected via wired connections 606 to the first channel connectors 404 of the two end boards and two of the light sources 604 are connected via wired connections 606 to the second channel connectors 406. According to one embodiment a first input is connected to a first channel connector 404 of the middle circuit board 202/104 via a first wired input 608*a* and a second input is connected to a second channel connector 408 of the middle circuit board 202/104 via a second wired input 608*b*. According to one embodiment the power source 602, electrical interface 106, and light fixtures, along with the wired connections 606, 608*a*, and 608*b* form two completed series circuits.

The lengths of the wired connections 606 and 608*a*, and 608*b* may vary considerably. According to one embodiment, the wired connections 606 of the light fixtures may be approximately as long as a frame 102 of a track light apparatus 100. For example, this may allow a light fixture 604 to be connected anywhere on an electrical interface 106 while being placed at any location along a length of a track of a frame 102. In one embodiment, the input wired connections 608 and 608*b* may be hundreds of feet long. According to one embodiment, the power source 602 may be remote mounted in one portion of a building and the wired connections 608*a* and 608*b* may run through the walls, ceiling, and/or floors of a building to a track light apparatus 100.

According to one embodiment, the power source 602 includes an intelligent power source for controlling the switching and/or dimming of the light fixtures 604. According to one embodiment, the power source 602 may include a low voltage power source for driving low voltage light fixtures. For example, the power source 602 may include at least one constant current power limited output with Class 2 voltage limits for driving low voltage light fixtures. In one embodiment, the power source 602 may have the ability to power and control each supply channel independently. According to one embodiment, the power source 602 may dim one channel independently of another channel.

According to one embodiment, a power source 602 comprises at least one output current source to provide power to one or more LED fixtures mounted on the track light apparatus 100. In one embodiment, the output current source(s) are class 2 circuits in accordance with the NEC, Article 725 requirements. At the time of writing, these requirements limit output power to 100 volt-amperes (VA) or less to protect against electrical fires and limit output voltage to less than 42.4 V peak to protect against shock hazards.

According to one embodiment, the track light apparatus 100 will have a class 2 rating. One of skill in the art will recognize that the power source and track light apparatus class rating may be varied without departing from the scope and content of the present disclosure. In one embodiment, a power source includes one or more output current sources. In one embodiment, the output current source provide a variable output voltage that varies depending on the voltage drop across the light fixtures while maintaining a constant current through the fixtures.

Varying exemplary embodiments of power sources 602 which may be used in conjunction with the track light apparatus 600 are disclosed in Canadian Patent Application No. CA 2,564,659 entitled "Modulation Method and Apparatus for Diming and/or Colour Mixing Utilizing LEDS" and Canadian Patent Application No. CA 2,734,757 entitled "Configurable LED Driver/Dimmer for Solid State Lighting Applications" which are incorporated herein by reference.

The light fixtures 604 may include any light fixture known in the art. For example, the electrical interface 106 and power source 602 may be designed for light sources that include light emitting diodes (LEDs). According to one embodiment, the light fixtures 504 may include one or more LEDs.

According to one embodiment, the power source 602 may control two or more channels independently to create a custom color temperature. For example, light fixtures on one channel may have one color temperature while light fixtures on a different channel may have a different color temperature. By adjusting the dimness or brightness of the light fixtures on different channels an overall color temperature provided by the light sources may be varied.

Figure 7B:
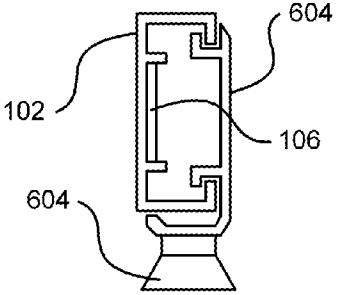
FIG. 7B is a cross-sectional side view of the light fixture of FIG. 7A mounted on a frame of a track light apparatus in accordance with the present invention.
Figure 7A:
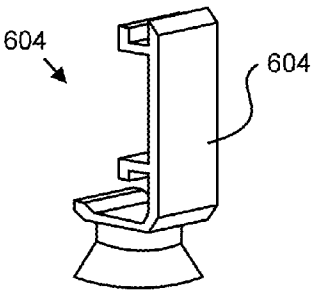
FIG. 7A is a perspective view of one embodiment of a light fixture in accordance with the present invention.

Turning now to FIGS. 7A and 7B one embodiment of a light fixture 604 is shown. FIG. 7A is a perspective view of one embodiment of a light fixture 604. According to one embodiment, the light fixtures include one embodiment of a bracket 702 for connecting to the frame 102 of the light track apparatus of FIGS. 2A and 2B. FIG. 7B is a cross sectional side view illustrating the light fixtures 604 of FIG. 7A connected to the frame 102 of the track light apparatus of FIGS. 2A and 2B, according to one embodiment. Electrical connection between the electrical interface 106 and the light fixture 604 has been omitted for simplicity.

According to one embodiment, the light fixture 604 includes a housing or socket for receiving one or more light sources or lamps. According to one embodiment, the light fixture 604 may include a socket or housing for receiving one or more light emitting diodes.

Figure 8:
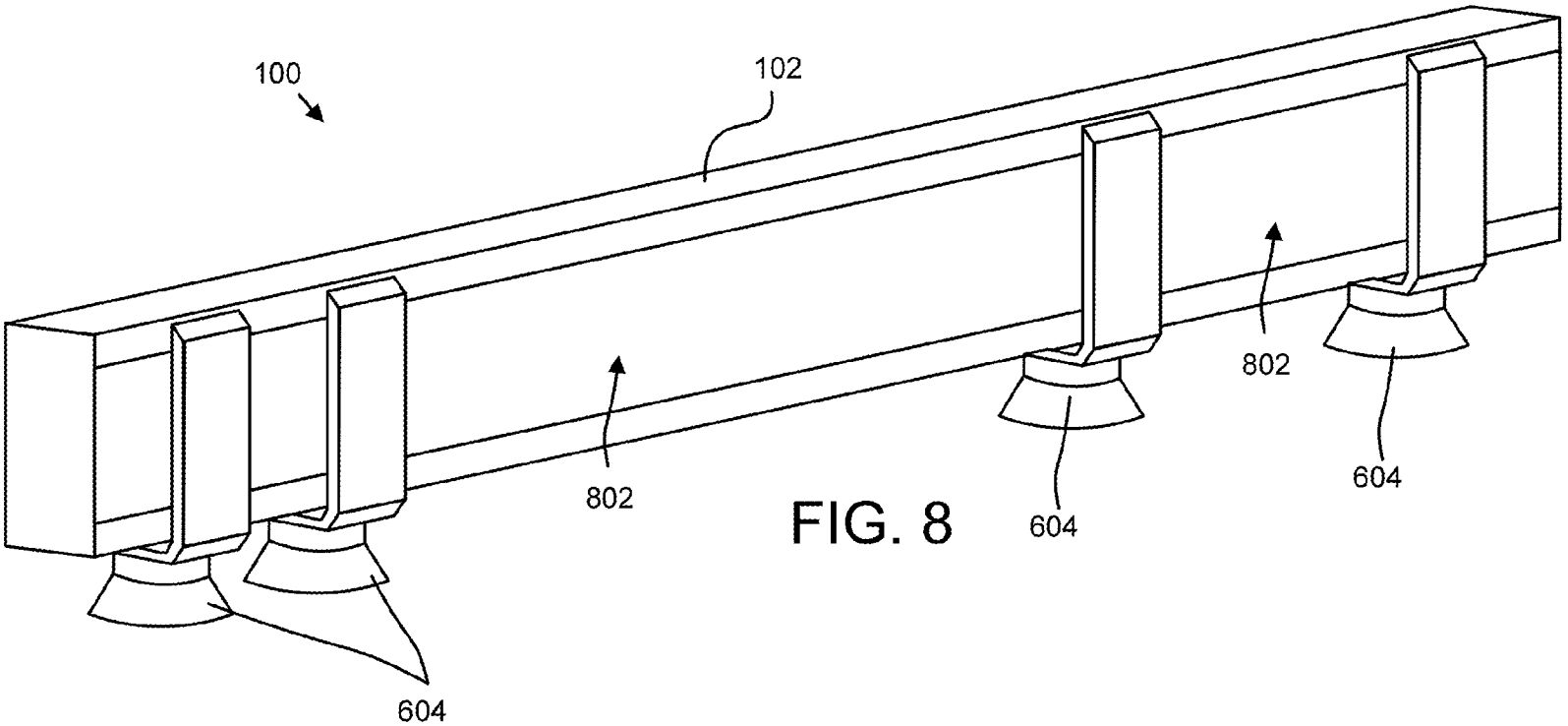
FIG. 8 is a perspective view illustrating one embodiment of a track light apparatus in accordance with the present invention.

FIG. 8 depicts a light track apparatus 100 with a plurality of mounted light fixtures 604. According to one embodiment, the light fixtures 604 may be connected to an electrical interface 106 in a similar manner as that depicted in FIG. 6. According to one embodiment, the track light apparatus 100 includes one or more covers 802 to cover at least a portion of a cavity of the track light apparatus 100. According to one embodiment, one or more covers 802 may be used to at least partially conceal the electrical interface within the elongated recess. According to one embodiment, the cover(s) 802 may be formed of a material similar in appearance to the frame 102. According to one embodiment the cover(s) 802 may be used to cover the electrical components to reduce danger of short and/or to keep dust or other material from coming in contact with internal electrical components.

Figure 9A:
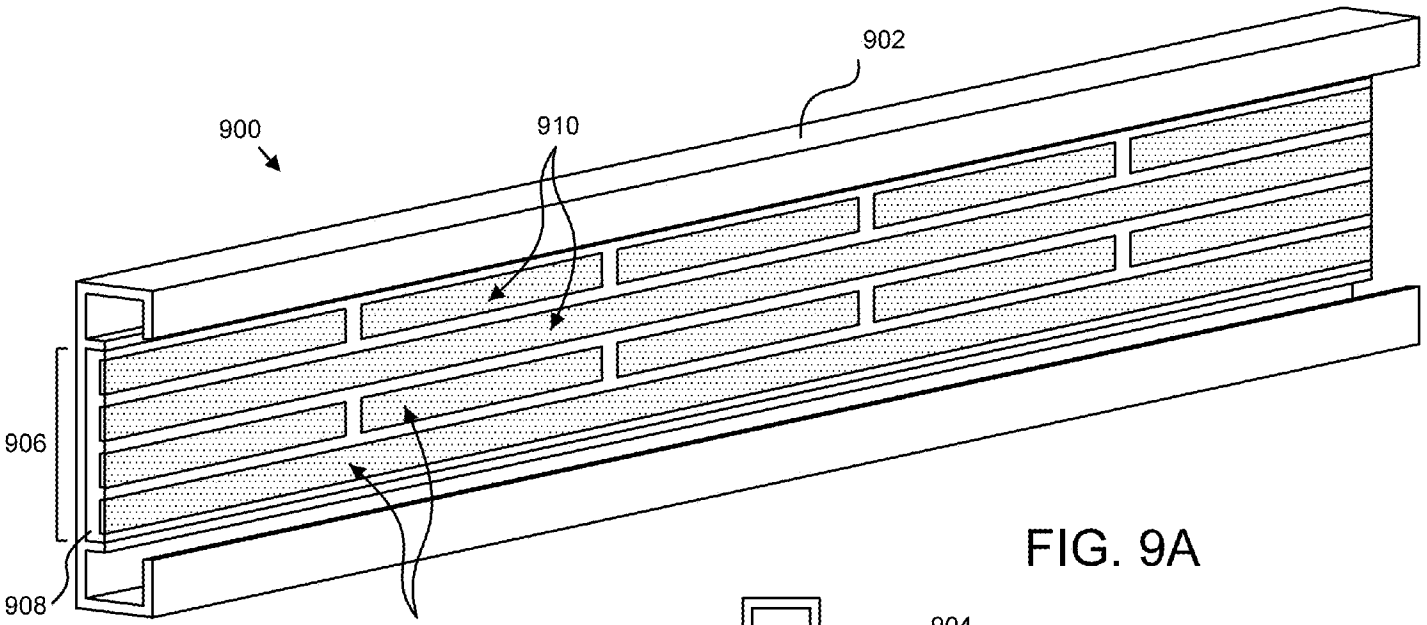
FIG. 9A is a perspective view illustrating one embodiment of a track light apparatus in accordance with the present invention.
Figure 9B:
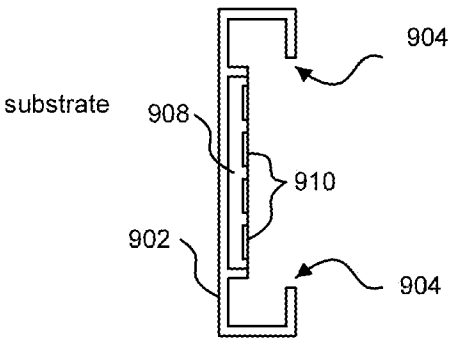
FIG. 9B is a cross-sectional side view illustrating one embodiment of a track light apparatus in accordance with the present invention.

Turning now to FIGS. 9A and 9B another embodiment of a track light apparatus 900 is shown. FIG. 9A is a perspective view of the track light apparatus 900 and FIG. 9B is a cross-sectional side view of the track light apparatus 900. In one embodiment, the track light apparatus 900 includes a frame 902 and an electrical interface 906.

In one embodiment, the frame 902 has an elongate shape and a 'C' shaped cross-sectional side view. One of skill in the art will recognize that the shape of the frame 902 is exemplary only and can vary considerably. According to the depicted embodiment, the frame 902 includes flanges 904 to act as a track for receiving one or more connectors. Exemplary connectors for the frame 902 and electrical interface 906 will be discussed in relation to FIGS. 10A and 10B.

In the depicted embodiment, the electrical interface 906 includes a substrate 908 which runs substantially the length of the frame 902. In one embodiment, the substrate 908 is a non conductive material. In the depicted embodiment, the electrical interface 906 includes a plurality of elongated conductors 910. In the depicted embodiment, the elongated conductors 910 include two conductors 910 which are continuous and two conductors 910 which each include four breaks. According to one embodiment, the electrical interface 906 is a two channel interface that can accommodate up to four light fixtures on each channel.

Figure 10B:
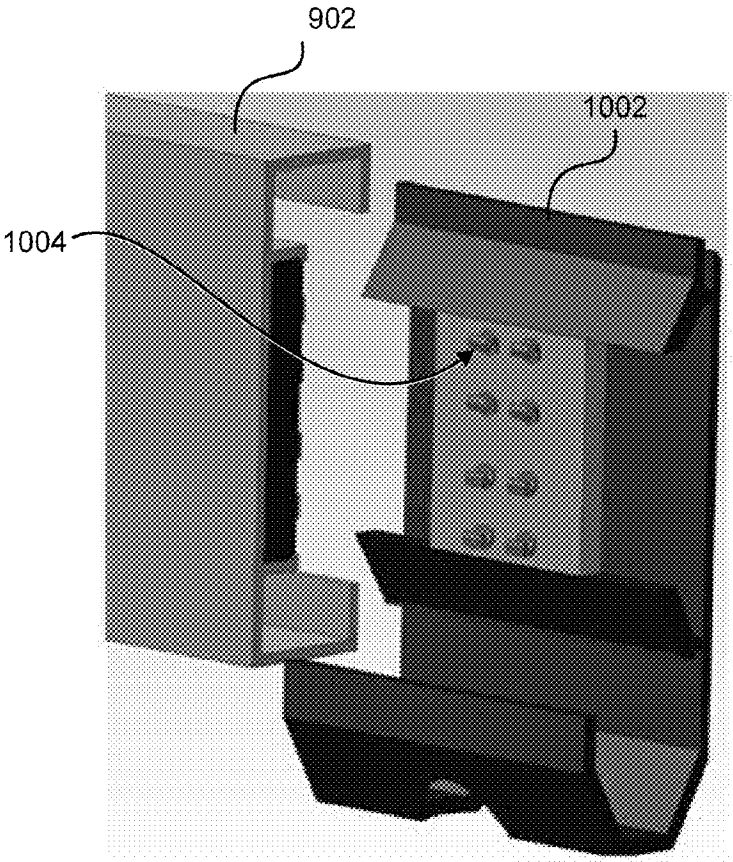
FIGS. 10A and 10B are perspective views of one embodiment of a hermaphroditic connector in accordance with the present invention.
Figure 10A:
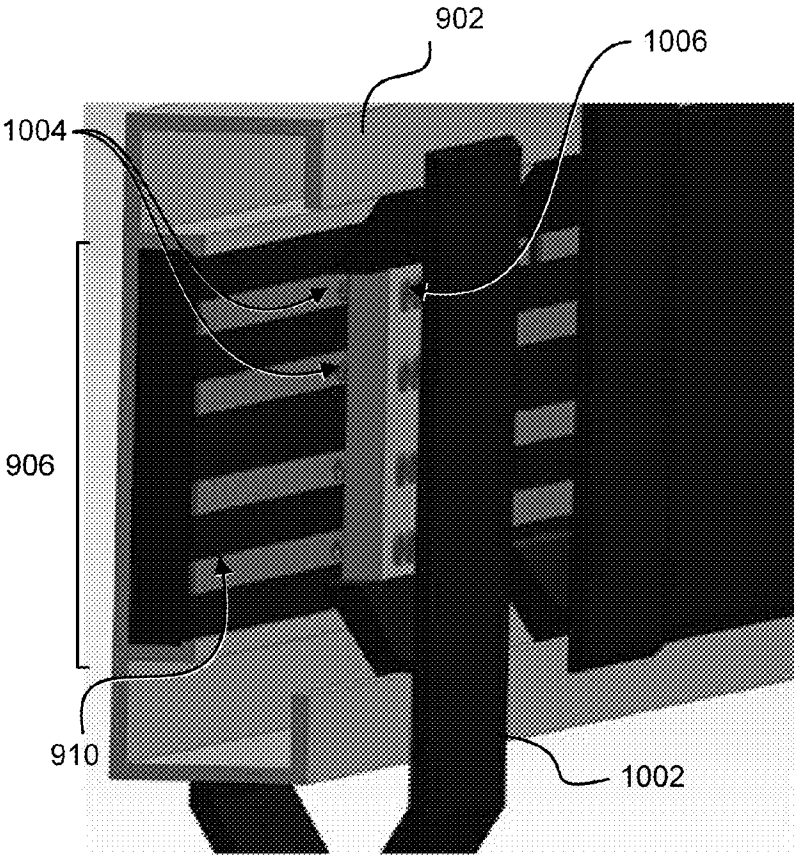

Turning now to FIGS. 10A and 10B one embodiment of a hermaphroditic connector 1002 for creating contact with the elongate conductors 910 of the track light apparatus 100 of FIGS. 9A and 9B is shown. FIG. 10A is a perspective back view and FIG. 10B is a perspective front view of a hermaphroditic connector 1002. In one embodiment, the hermaphroditic connector 1002 comprises a bracket for connected to the frame 902. In one embodiment, the hermaphroditic connector 1002 includes a plurality of prongs 1004 for creating electrical contact with an elongate conductor 910. In one embodiment, the prongs 1004 are electrically connected to contact surfaces 1006. According to one embodiment, the contact surfaces 1006 may be used to create an electrical connection with a jumper, power supply, or light fixture. For example, a jumper, power supply, or light fixture may be electrically connected to different contact surfaces 1006 of different prongs 1004 to create an electrical connection across a break in the elongate conductors 910 or supply voltage to the elongate conductors 910.

Figure 11:
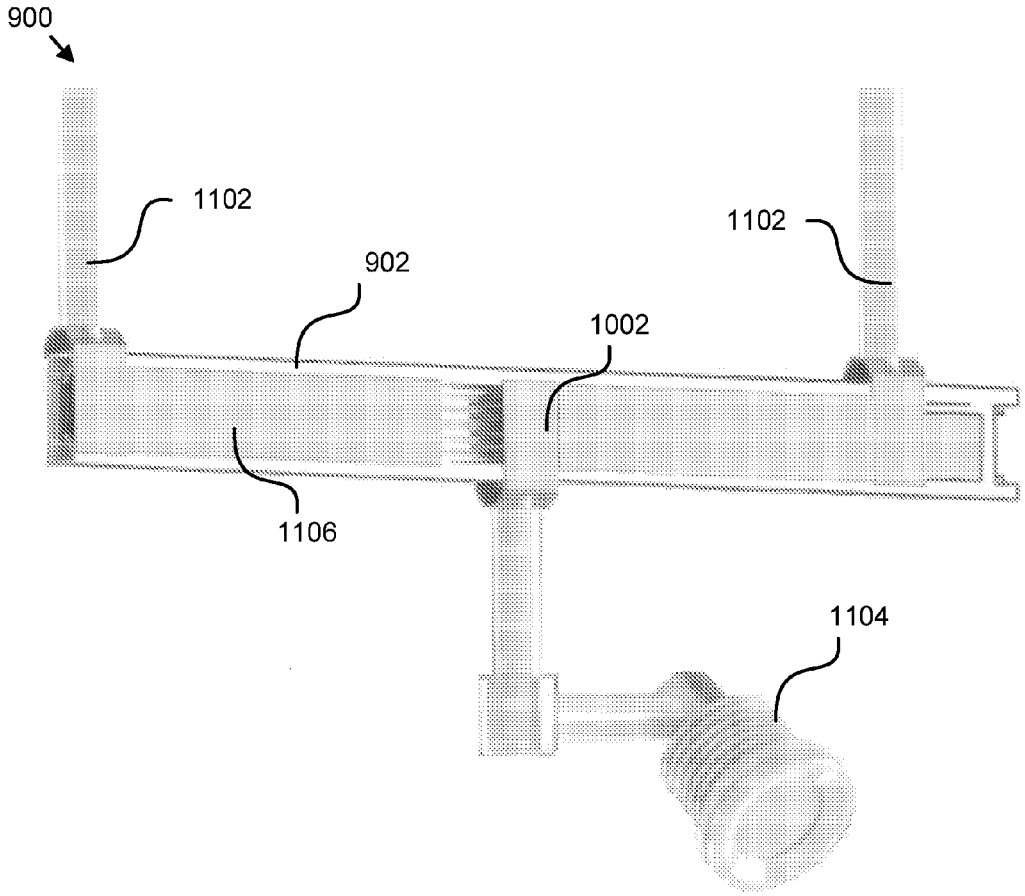
FIG. 11 is a perspective view illustrating one embodiment of a track light apparatus in accordance with the present invention.

According to one embodiment, a hermaphroditic connector 1002 may function as power distributor 104. For example, an electrical input from a power source may be supplied to two or more of the contact surfaces 1006. The prongs 1004 may create contact with the elongated conductors 910 and thereby provide an electrical connection from one or more inputs to one or more supply channels. Jumpers and/or light fixtures may be connected across breaks using additional hermaphroditic connectors 1002 to form a closed series circuit FIG. 11 illustrates one embodiment of an at least partially installed track light apparatus 900. The track light apparatus 900 is depicted with the frame 902 mounted on arms 1102. According to one embodiment, the arms 1102 extend to a ceiling. According to one embodiment, electrical wires from a power source extend through at least one of the arms 1102 into the frame 902. In one embodiment, a light fixtures 1104 is mounted on a hermaphroditic connector 1002 which provides electrical contact with an electrical interface. In one embodiment, one or more covers 1106 cover internal electrical components of the track light apparatus 900.

Figure 12:
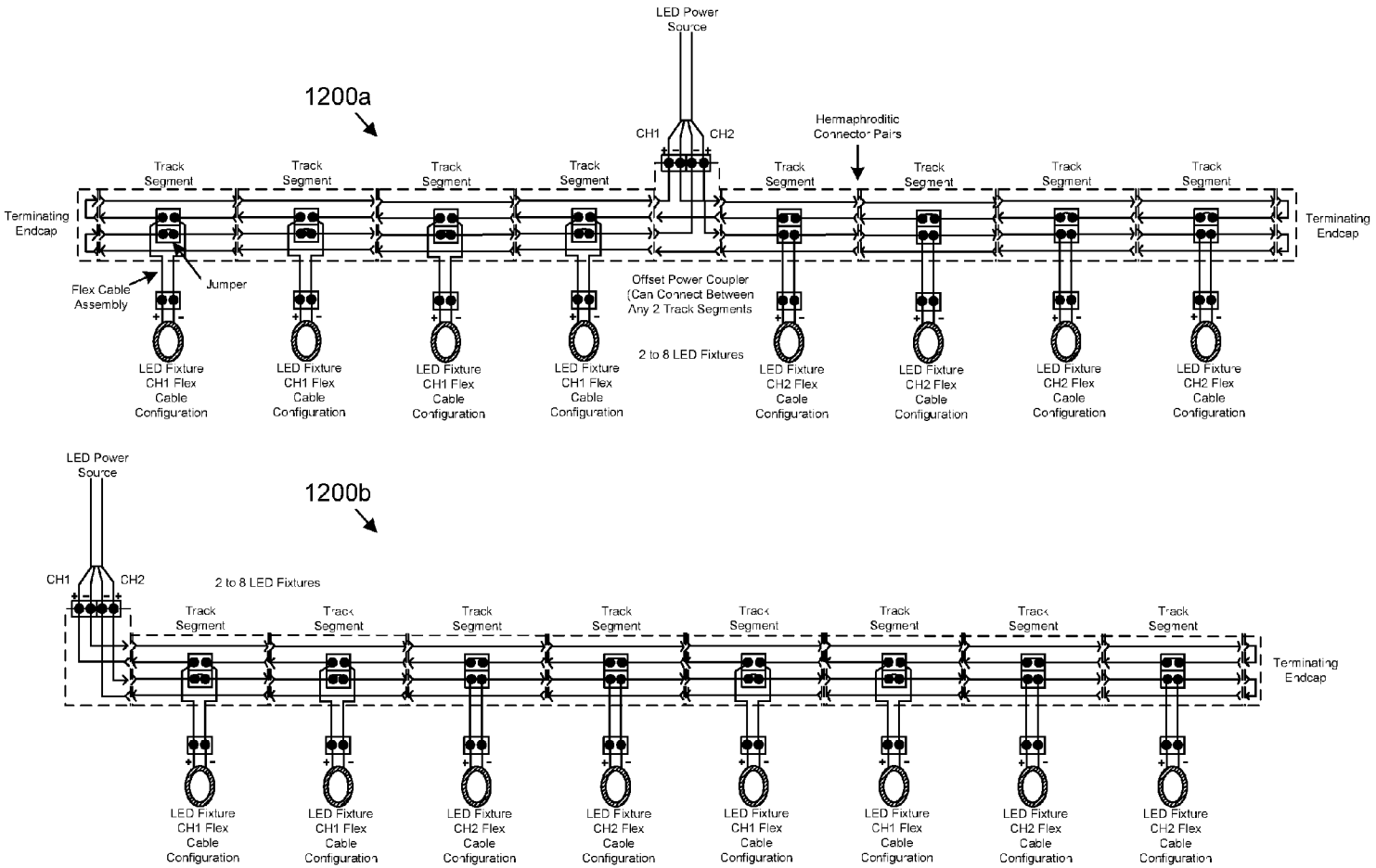
FIG. 12 is a schematic electrical diagram illustrating one embodiment of a track light apparatus in accordance with the present invention.

FIG. 12 depicts two exemplary embodiments of schematic electrical diagrams 1200*a* and 1200*b* of varying embodiments of a track light apparatus. In the depicted embodiments, the schematic electrical diagrams 1200*a* and 1200*b* illustrate two channel track light apparatuses. In the depicted embodiment, each channel can connect to 4 or less light fixtures.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A track light apparatus, the apparatus comprising:

a frame comprising a track, the track configured to support a plurality of light fixtures;

a power distributor, the power distributor electrically connecting two or more inputs to two or more supply channels, wherein each supply channel of the two or more supply channels is electrically insulated from other supply channels of the two or more supply channels; and an electrical interface comprising electrical components forming the two or more supply channels, wherein each supply channel forms an incomplete series circuit, wherein each series circuit comprises two or more breaks, wherein one of a light fixture and a jumper is electrically connected across each break to complete the series circuits and form series circuits comprising two or more light fixtures, wherein the frame comprises an elongated recess, and wherein the electrical interface is disposed within the elongated recess.

2. The apparatus of claim 1, wherein the frame comprises an elongated shape and wherein the plurality of light fixtures may be supported substantially along the length of the frame on the track.

3. The apparatus of claim 1, further comprising a cover for at least partially concealing the electrical interface within the elongated recess.

4. The apparatus of claim 1, wherein the frame comprises one of a C-shaped cross-section and an I-shaped cross-section.

5. The apparatus of claim 1, wherein the power distributor comprises an input connector for receiving electrical input for the two or more inputs from one or more power sources.

6. The apparatus of claim 1, wherein the power distributor comprises a printed circuit board, the printed circuit board comprising a plurality of traces.

7. The apparatus of claim 1, wherein the electrical interface comprises two or more printed circuit boards.

8. The apparatus of claim 7, wherein the two or more printed circuit boards are connected in series to form the incomplete series circuits of each supply channel.

9. The apparatus of claim 1, further comprising a cover for selectively baring or covering at least a portion of the electrical interface.

10. The apparatus of claim 1, wherein the light fixture comprises a housing for supporting one or more lamps.

11. The apparatus of claim 10, wherein the one or more lamps comprise one or more light emitting diodes.

12. The apparatus of claim 1, wherein each supply channel comprises a contact surface on each side of the breaks.

13. The apparatus of claim 1, wherein the two or more breaks comprise one or more of factory created breaks and technician created breaks.

14. A method comprising:

providing an apparatus comprising, a frame comprising a track, the track configured to support a plurality of light fixtures, a power distributor, the power distributor electrically connecting two or more inputs to two or more supply channels, wherein each supply channel of the two or more supply channels is electrically insulated from other supply channels of the two or more supply channels, and an electrical interface comprising electrical components forming the two or more supply channels, wherein each supply channel forms an incomplete series circuit, wherein each series circuit comprises two or more breaks;

mounting two or more light fixtures to the frame, wherein the frame comprises an elongated recess, and wherein the electrical interface is disposed within the elongated recess;

electrically connecting one of a light fixture of the two or more light fixtures and a jumper across each of the two or more breaks to form a series circuit of two or more light fixtures on at least one of the two or more supply channels; and applying electrical power to each supply channel, whereby the light fixtures are energized to emit light.

15. The method of claim 14, wherein the frame comprises an elongated shape and wherein the plurality of light fixtures may be supported substantially along the length of the frame on the track.

16. The method of claim 14, further comprising a cover for at least partially concealing the electrical interface within the elongated recess.

17. The method of claim 14, wherein the electrical power applied to each supply channel comprises a low voltage.

18. A system comprising:

a power supply, the power supply providing electrical power to two or more inputs;

an apparatus comprising, a frame comprising a track, the track configured to support a plurality of light fixtures, a power distributor, the power distributor electrically connecting two or more inputs to two or more supply channels, wherein each supply channel of the two or more supply channels is electrically insulated from other supply channels of the two or more supply channels, and an electrical interface comprising electrical components forming the two or more supply channels, wherein each supply channel forms an incomplete series circuit, wherein each series circuit comprises two or more breaks; and the plurality of light fixtures, wherein one of a light fixture of the plurality of fixtures and a jumper is electrically connected across each break to form series circuits comprising two or more light fixtures, wherein the frame comprises an elongated recess, and wherein the electrical interface is disposed within the elongated recess.

* * * * *